US006994229B2

(12) United States Patent
McTague et al.

(10) Patent No.: US 6,994,229 B2
(45) Date of Patent: Feb. 7, 2006

(54) DEVICE FOR DISPENSING LAMINAR ITEMS

(75) Inventors: Michael McTague, Shannon (IE); Irene C. Power, Carrick-on-Suir (IE)

(73) Assignee: Dell Products I.P., Round Rock, TX (US)

( * ) Notice: Subject to any disclaimer, the term of this patent is extended or adjusted under 35 U.S.C. 154(b) by 58 days.

(21) Appl. No.: 10/338,990

(22) Filed: Jan. 9, 2003

(65) Prior Publication Data

US 2004/0112910 A1 Jun. 17, 2004

(30) Foreign Application Priority Data

Dec. 11, 2002 (IE) ..... 2002/0877

(51) Int. Cl.
*G07F 11/00* (2006.01)

(52) U.S. Cl. ..... 221/2; 221/9; 221/71

(58) Field of Classification Search ..... 221/2, 221/4, 9, 13, 71, 73, 151, 153; 156/DIG. 28, 156/DIG. 33
See application file for complete search history.

(56) References Cited

U.S. PATENT DOCUMENTS

| | | | | |
|---|---|---|---|---|
| 3,619,326 A | * | 11/1971 | Burbidge | 156/384 |
| 4,194,646 A | * | 3/1980 | Oglander et al. | 221/73 |
| 4,385,958 A | * | 5/1983 | Long | 156/361 |
| 4,459,170 A | | 7/1984 | Kerwin | |
| 4,515,288 A | | 5/1985 | Atalla | |
| 4,585,144 A | | 4/1986 | Granzow et al. | |
| 4,695,954 A | * | 9/1987 | Rose et al. | 221/15 |
| 5,232,540 A | * | 8/1993 | Southwell et al. | 156/361 |
| 5,273,183 A | * | 12/1993 | Tuttobene | 221/7 |
| 5,304,264 A | * | 4/1994 | Wehrmann | 156/64 |
| 5,421,946 A | * | 6/1995 | Flaig | 156/361 |
| 6,053,358 A | * | 4/2000 | Tong | 221/151 |
| 6,427,091 B1 | | 7/2002 | Davis et al. | |

FOREIGN PATENT DOCUMENTS

| | | |
|---|---|---|
| GB | 1228843 | 4/1971 |
| GB | 1302819 | 1/1973 |
| GB | 2299319 | 10/1996 |
| IE | 020877 | 11/2002 |
| JP | 8053114 | 2/1996 |
| WO | WO 00/63101 | 10/2000 |

* cited by examiner

*Primary Examiner*—Gene O. Crawford
*Assistant Examiner*—Rashmi Sharma
(74) *Attorney, Agent, or Firm*—Haynes and Boone, LLP

(57) ABSTRACT

A device for dispensing labels of value comprises a lockable housing for containing a roll of transport medium having a plurality of labels releasably adhered thereto successively along its length. The housing has a slot through which the transport medium can be discharged from the housing, and pinch rollers for engaging the medium outside the housing adjacent to the slot and, upon actuation, for drawing the medium through the slot. Upon command the pinch rollers are actuated to draw only sufficient medium through the slot to expose a single label for removal from the medium. The pinch rollers engage the medium with sufficient frictional force to rupture the medium if an attempt is made to manually pull the transport medium out of the slot when the rollers are not actuated.

16 Claims, 3 Drawing Sheets

DEVICE FOR DISPENSING LAMINAR ITEMS

BACKGROUND

This disclosure relates to a device for dispensing laminar items.

In the present specification the term "laminar item" means any generally flat item which can be releasably attached to a flexible backing medium. Thus it includes labels, banknotes, cards, envelopes (empty or containing other items such as banknotes), flat packages, documents and the like. The disclosure is especially, but not exclusively, concerned with a device for dispensing so-called Certificates of Authenticity (COA) labels.

In the manufacture of personal computers (PCs) with pre-loaded software, it is common practice to supply one or more COA labels with each computer, which label(s) correspond to and act as a valid license for software loaded on the computer. COA labels embody features such as holograms which are difficult to counterfeit, so that genuine labels are subject to theft because they can be used to "authenticate" pirate copies of software. It is therefore desirable to dispense such labels using automated label dispensers which are secure against the unauthorized theft of labels by the operative.

COA labels are supplied releasably attached to rolls of transport, i.e. backing, material. U.S. Pat. Nos. 4,515,288 and 4,585,144 describe currency dispensers in which a secure housing contains a highly elongated flexible transport medium to which banknotes are removably attached. The transport medium follows a predetermined path inside the housing and individual banknotes are ejected through a slot in the housing as the transport medium moves past.

In principle these devices could be adapted for the dispensing of COA labels from rolls. However, in each case the transport medium remains entirely within the secure housing, and the operation of the devices requires the presence of a leader (strip of blank transport medium ahead of the first banknote) and/or trailer (strip of blank transport medium after the last banknote), and therefore cannot dispense banknotes located immediately adjacent the front and/or rear ends of the transport medium. Furthermore, these prior devices are unable to dispense banknotes from short lengths of transport medium.

These are serious deficiencies for the dispensing of COA labels. COA labels are commonly supplied on a roll of transport material with the labels disposed edge-to-edge along 15 the full length of the roll from the front end to the rear end. There is no leader or trailer. It is also a common requirement for COA labels to be dispensed from short lengths of transport medium bearing, for example, just a few COA labels. This would not be possible with the prior devices.

It would therefore be beneficial to provide an improved device for dispensing laminar items such as COA labels.

SUMMARY

According to the present disclosure there is provided a device for dispensing laminar items, comprising a secure housing for containing an elongated flexible transport medium having a plurality of laminar items releasably adhered thereto successively along its length, a slot through which the transport medium can be discharged from the housing in its direction of elongation, a drive means for engaging the medium adjacent to the slot and, upon actuation, for driving the medium through the slot, and control means operable upon command for actuating the drive means to drive only sufficient medium through the slot to expose a predetermined number of laminar item(s) for removal from the medium, the system further including means for retaining the transport medium against movement when the drive means is not actuated such that the medium will rupture if an attempt is made to manually pull the medium out of the slot.

Preferably the retaining means comprises the drive means. Preferably, too, the drive means is actuated by a motor which is connected to the drive means by a self-locking coupling. By a "self-locking" coupling is meant that the coupling is operable from only one end, in this case the end connected to the motor, so that the motor can readily actuate the drive means to drive a laminar item from the slot but the drive means cannot be directly actuated by hand at its own end of the coupling. An example of such a coupling is a gear train including a worm gear driven directly by the motor.

In a preferred embodiment the drive means comprises a pair of pinch rollers which engage the medium outside the housing and draw the medium through the slot.

In another aspect, the disclosure provides a system for dispensing software authorization labels for personal computers (PCs) containing pre-loaded software, each PC bearing a unique machine-readable ID, the system comprising a plurality of label dispensing devices each for containing a respective stock of software authorization labels relating to a different item of software, means for reading the unique ID on each PC, means for determining, from a stored record correlating software items with PC ID, which software items are loaded, or are to be loaded, onto each PC, and means responsive to each said determination for automatically actuating those devices corresponding to the said determined software items to dispense a single label each.

In a still further aspect, the disclosure provides a method for dispensing software authorization labels for personal computers (PCs) containing pre-loaded software, each PC bearing a unique machine-readable ID, the method comprising providing a plurality of label dispensing devices each containing a respective stock of software authorization labels relating to a different item of software, reading the unique ID on each PC, determining, from a stored record correlating software items with PC ID, which software items are loaded, or are to be loaded, onto each PC, and, responsive to each said determination, automatically actuating those devices corresponding to the said determined software items to dispense a single label each.

BRIEF DESCRIPTION OF THE DRAWINGS

An embodiment of the disclosure will now be described, by way of example, with reference to the accompanying drawings, in which.

DETAILED DESCRIPTION

Figure 1:
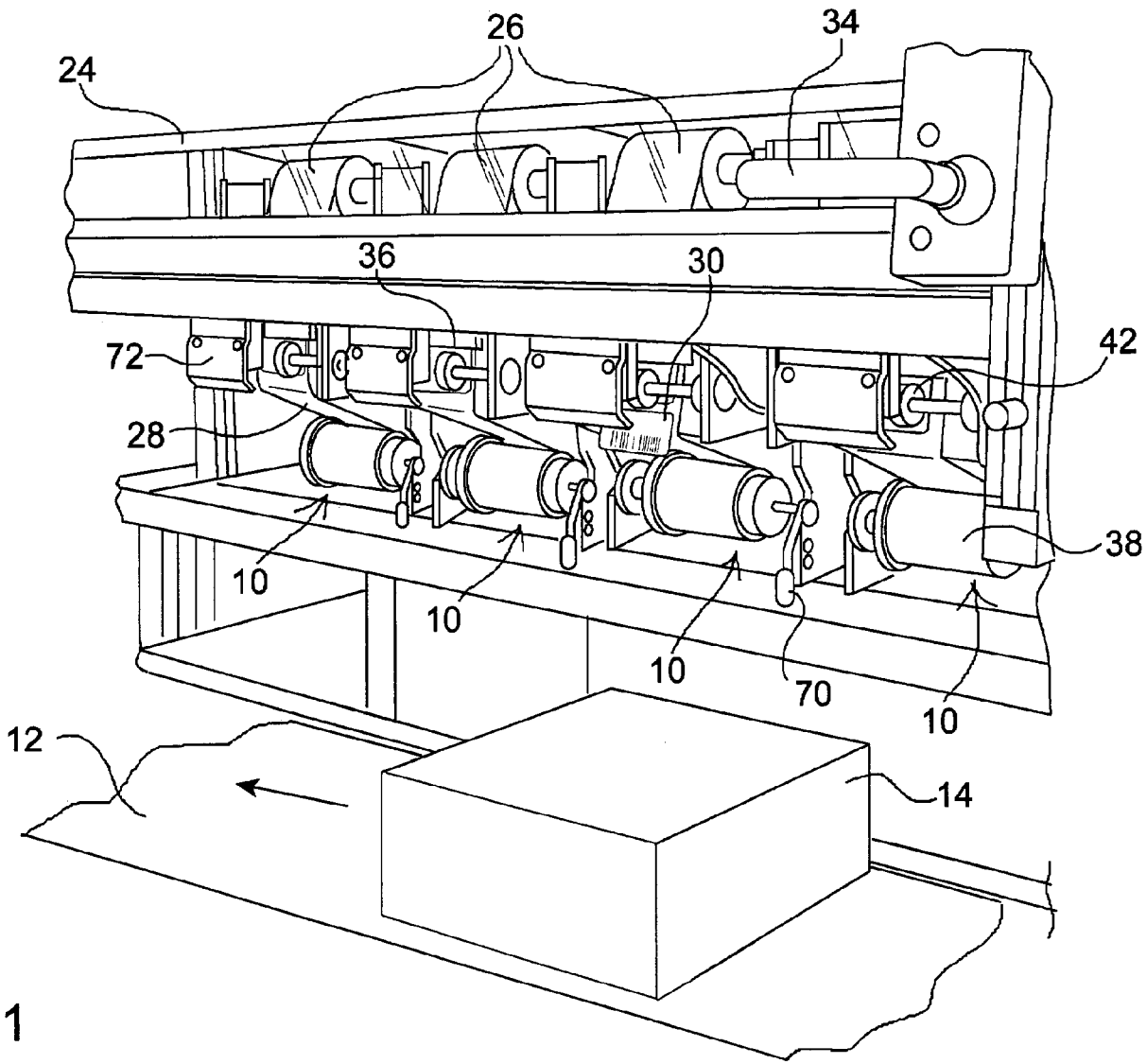
FIG. 1 is a perspective view of an embodiment of an apparatus including a plurality of devices for dispensing COA labels.
Figure 3:
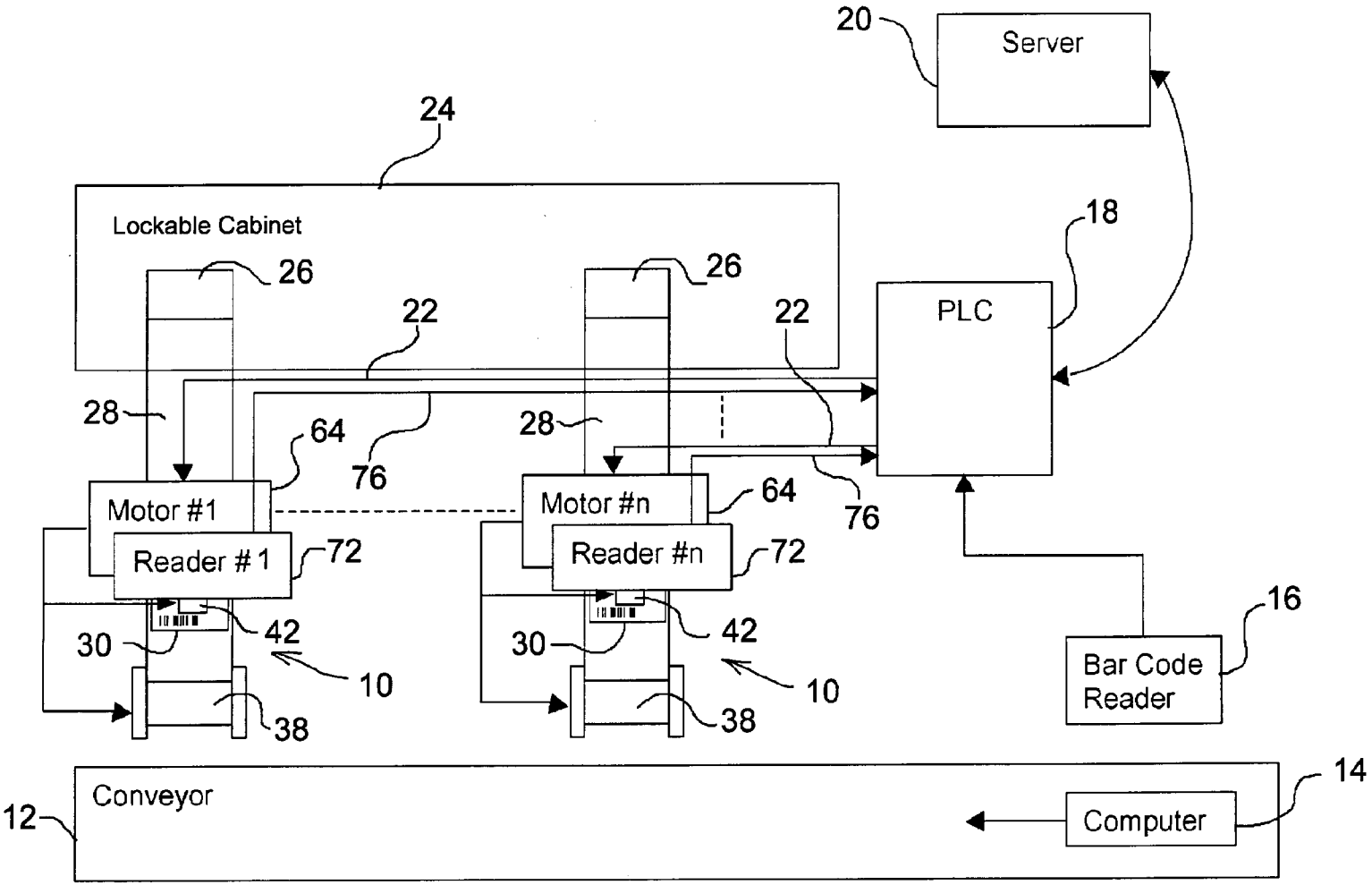
FIG. 3 is a block schematic diagram of an embodiment of the apparatus of FIG. 1 including its control circuitry.

Referring first to FIGS. 1 and 3, an apparatus for dispensing COA labels comprises a plurality of label dispensing devices disposed alongside a conveyor 12 for conveying PC system units 14. Each device 10 contains a stock of COA labels relating to a different item of software which could be preloaded onto a PC 14. Each PC 14 bears a unique barcode which is, for example, the serial number of that PC—in any event, the barcode is a unique ID for that particular PC. The barcode ID is scanned by a barcode reader 16 as the PC approaches the devices 10.

The scanned ID is sent to a programmed logic controller (PLC) 18 which controls the operation of the label dispensing devices 10 and is in communication with a central server 20 which maintains a record, by PC ID, of which software is, or is to be, pre-loaded onto each PC (the PCs are "built-to-order" and therefore may not all contain the same software). The PLC 18 interrogates the server 20 which returns a list of the software items pre-loaded onto the particular PC 14 whose barcode has just been read and for which a COA label is required. Each device 10 contains COA labels relating to a different item of software. In response to the list returned by the server 20 the PLC 18 issues a command over a respective line 22 (FIG. 3) to each device 10 which is required to dispense a COA label for an item of software loaded, or to be loaded, onto the current PC 14. The construction and operation of each label dispensing device 10 will now be described with additional reference to FIG. 2.

Each device 10 comprises a secure housing in the form of a lockable cabinet 24 containing a roll 26 of a highly elongated flexible transport medium 28, the medium 28 having a plurality of COA labels 30 releasably adhered thereto successively along its length. The labels 30 are disposed edge-to-edge along the roll with only a small gap between adjacent labels, and the transport medium 28 may have a transverse line of weakening, such as a line of perforations, between immediately adjacent labels. The COA labels on each roll 26 relate to the same software item, but each has a unique barcode 32 extending transversely across the width of the transport medium. In the present embodiment several devices 10 share the same cabinet 24 but each could have its own separate cabinet. The cabinet 24 may be opened by a lockable handle 34 to allow fresh rolls of COA labels to be loaded.

Each roll 26 is freely rotatable in the cabinet 24 and the transport medium 28, bearing the labels 30, emerges from the cabinet through a respective narrow slot 36 in the base of the cabinet. From the slot 36 the transport medium travels along a predetermined path to a take-up spool 38, the medium 28 initially traveling substantially vertically downwardly from the slot 36 but then being abruptly deflected around a transverse member 40 so that the medium thereafter travels rearwardly and downwardly towards the take-up spool 38.

Immediately upon its exit from the slot 36 the medium 28 passes between a pair of pinch rollers of which the front roller 42 is visible in the drawings but the rear roller is hidden from view behind the medium 28. The front pinch roller 42 is non-rotatably fixed on an axle 44 which is rotatably supported at each end by opposite side plates 46, 48 of the device and extends perpendicularly to the direction of travel of the medium 28 (indicated by the arrow in FIG. 2). The rear pinch roller is non-rotatably fixed on a further axle, also not visible, which, like the axle 44, is rotatably supported at each end by the side plates 46, 48 and extends perpendicularly to the direction of travel of the medium 28, i.e. parallel to the axle 44. A respective toothed gear wheel 50, 52 is non-rotatably fixed to one end of each axle, the gear wheels meshing so that rotation of the rear axle, i.e. the axle bearing the rear pinch roller, will rotate the front axle 44.

A second toothed gear wheel 54 is non-rotatably fixed to the other end of the rear axle and a toothed belt 56 passes under tension around the gear wheel 54 and a further toothed gear wheel 58, the latter being one of a pair of coaxial toothed gear wheels 58, 60 mounted for co-rotation on a common shaft 62 mounted to the side plate 46. Upon actuation of the device, to be described, the gear wheel 60 is driven by a motor 64 (FIG. 3) which drives the gear wheel 58 and hence the belt 56. The latter rotates the rear axle via the gear wheel 54 and the meshing gear wheels 50, 52 rotate the front axle 44. In this way the front 42 and rear pinch rollers are driven in opposite directions to draw the transport medium 28 out of the slot 36 in the direction indicated by the arrow in FIG. 2.

The take-up spool 38 is fixed on a further rotatable axle 66, parallel to the axle 44, which is driven via a slip clutch (not shown) by a still further toothed gear wheel 68 which meshes with the gear wheel 60. Thus, as the gear wheel 60 is driven by the motor 64 the spool 38 is rotated to maintain a slight tension in the medium 28 and thus avoid slack in the path of the medium from the slot 36 to the take-up spool. The slip clutch compensates for the increasing diameter of the roll of spent medium as the labels are dispensed. A full take-up spool 38 can be replaced by an empty one by lifting a lockable handle 70 which releases the axle 66.

Each device 10 also includes a bar code scanner 72 mounted immediately in front of the pinch rollers. This is arranged to scan along a line 74 (FIG. 2) transverse to the direction of movement of the medium 28, i.e. across the width of the medium. It is to be understood that the line 74 is not a mark on the labels 30—rather, it is the spatially fixed line along which the barcode scanner scans in operation and will be seen as a red line of illumination when the scanner is in operation.

Figure 2:
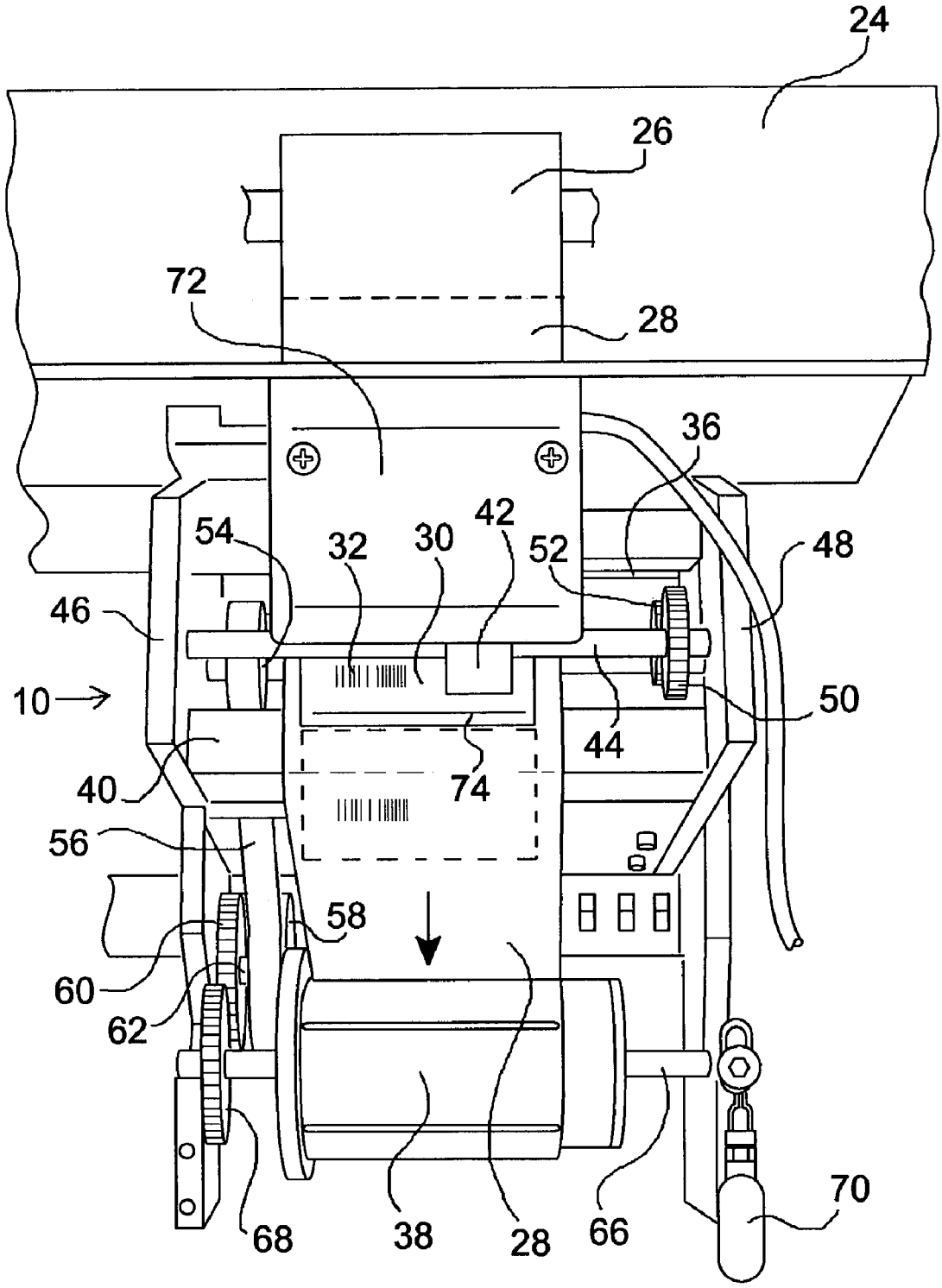
FIG. 2 is a front view of an embodiment of one of the label dispensing devices of FIG. 1.

The operation of the device 10 to dispense a single label will now be described, such operation being initiated by a command on the line 22 from the PLC 18. Prior to receipt of such command, the device 10 is at rest with a label 30 at least partially emerged from the slot 36 and halted at a position where the pinch rollers bear on the label from opposite sides. The bar code 32 of the label is not advanced sufficiently to be detected by the scanner 72, i.e. the leading edge of the barcode is spaced back from the line 74. This rest position is shown in FIG. 2 for the label 30 in solid lines. Ahead of the label 30 shown in FIG. 2 all the previous labels have been dispensed and removed from the transport medium 28.

Upon receipt of the command the motor 64 is energized to rotate the gear wheel 60. The motor 64 does not rotate the gear wheel 60 directly, but via a self-locking coupling as previously defined. In the present case the motor 64 drives the gear wheel 60 via a worm gear (not shown). This advances the transport medium 28, via the various pinch rollers, gear wheels and toothed belt as previously described, so that the transport medium bearing the label 30 is slowly drawn from the slot 36 by the pinch rollers. At the same time the barcode scanner 72 is energized to initiate scanning of the label 30.

As soon as the scanner 72 detects the leading edge of the barcode 32 it sends the detected code (which, it will be recalled, is unique to that label) back to the PLC 18 on the line 76. This data is passed on to the server 20 which therefore now has a record of which particular COA label, as identified by its unique barcode, was issued to which PC, as identified by its respective ID. At the same time, the detection of the leading edge of the barcode 32 starts a timer in the PLC 18. The timer counts down a period of continued tenderisation of the motor 64 sufficient to release the label 30 from the pinch rollers.

At the end of the countdown period the motor 64 is de-energized in response to a further signal sent on the line 22 (it will be understood that both lines 22 and 26 are actually multi-core cables to allow for efficient and sophisticated control signals and data to be transmitted between the device 10 and the PLC 18). The countdown period is selected such that after the leading edge of the barcode 32 is detected the medium 28 is advanced by less than the pitch of the laminar items along the medium. Thus the next label on the medium stops approximately in the same position as the previous label. By using the detection of the leading edge of the barcode 32 as a datum each time a label is dispensed, the need for high precision motors and drive mechanisms is avoided.

Upon de-energization of the motor 64 at the end of the countdown period, the dispensed label 30 is in the position shown in dashed lines in FIG. 2. The labels 30 are sufficiently stiff in relation to the strength of their adhesion to the transport medium 28 that they automatically detach from the medium 28 where the latter changes direction at the transverse deflection member 40. This leaves only the top edge of the dispensed label 30 still adherent to the medium 28, so that it can easily be detached by hand.

In order to deter theft of COA labels from the device 10, in the rest position of the device (i.e. when the motor 64 is de-energized) the pinch rollers, of which the front roller is shown at 42, are designed to press on the medium 28 with a sufficiently large frictional force that the medium 28 and label 30 will rupture if any attempt is made to manually pull the transport medium 28 out of the slot 36. It will be understood, of course, that the pinch rollers cannot be forced to rotate by pulling on the transport medium due to the selflocking coupling between the motor 64 and the gear wheel 60.

Although the above has described the operation of the device 10 with sufficient labels already dispensed to allow a length of spent transport material 28 to be attached to the take up spool 38, it is clear that the device will operate to dispense the very first label 30 from a roll, even when the label is right up against is the leading edge of the transport medium. This situation will apply, for example, when a fresh roll of labels is placed in the device. A supervisor with authority to open the cabinet 24 will place the fresh roll in the cabinet and feed the free end through the slot 36. The motor 64 will be energized sufficiently to feed the first label to the start position shown in FIG. 2. Thereafter the device operates as described and the spent medium 28 is attached to the take-up spool when enough labels have been dispensed.

It is also clear that the device will dispense the very last label from the roll, even if it is right at the trailing edge of the roll.

Modifications of the above embodiment are possible. For example, the above device has been designed to dispense only a single label at a time. In other applications, the device could be designed to dispense a predetermined number of labels (or other laminar items) at a time. The transport medium could be in fanfold form rather than in a roll.

Also, the transport medium could be sprocket driven rather than driven by pinch rollers, with sprocket holes being formed along the opposite edges of the medium. Clearly, provided the sprockets are locked against rotation when the device is at rest, any attempt to pull the medium through the slot will rupture the medium. Although the sprocket holes would generally not run through the labels, the presence of a torn medium will be an immediate indication of the theft or attempted theft of the labels. In other embodiments the pinch rollers or other drive means could be inside the lockable cabinet so as to push the medium through the slot rather than pull it through the slot as described.

It is also possible to prevent movement of the transport medium when the pinch rollers (or other drive means) are not actuated by using a mechanism other than the drive means itself. Thus a pair of clamping members could be provided transversely on each side of the transport medium just inside the slot, and these would normally be biased against one another to clamp the medium except when the motor is energized, in which case they are temporarily moved apart.

The embodiments described herein may be modified or varied without departing from the scope of the disclosure.

What is claimed is:

1. A device for dispensing laminar items, comprising:

a secure housing for containing an elongated flexible transport medium having a plurality of laminar items releasably adhered thereto successively along its length;

a slot through which the transport medium can be discharged from the housing in its direction of elongation;

a timer controlled drive means comprising a pair of pinch rollers for engaging the medium adjacent to the slot and, upon actuation, for driving a repeatable amount of the medium through the slot;

control means operable upon command for actuating the drive means to drive only sufficient medium through the slot to expose a predetermined number of laminar items for removal from the medium;

self-locking means for retaining the transport medium against forced manual movement when the drive means is not actuated such that the medium will rupture if an attempt is made to manually pull the medium out of the slot;

the pinch rollers pressing on the medium with a sufficient frictional force to rupture the medium and laminar items in response to an attempt to manually pull the medium out of the slot;

a scanning device; and the laminar items each including a machine detectable feature, the dispensing device halting each successive laminar item at a position not readable by the scanning device prior to receipt of a command to advance the transport medium.

2. A device as claimed in claim 1, wherein the retaining means comprises the drive means itself.

3. A device as claimed in claim 2, wherein the self-locking means includes a self-locking coupling.

4. A device as claimed in claim 1, wherein the pair of pinch rollers bear on opposite sides of the medium respectively, the drive means being actuated by rotating at least one of the rollers.

5. A device as claimed in claim 1, wherein the drive means engages the medium outside the housing and draws the medium through the slot.

6. A device as claimed in claim 1, wherein the spent medium is wound on a take-up spool which maintains a tension in the medium, and wherein the medium is subject to an abrupt change of direction along its path from the slot to the take-up spool, the laminar item being sufficiently stiff in relation to the strength of its adhesion to the medium that the laminar item automatically detaches from the medium where the latter changes direction.

7. A device as claimed in claim 1, wherein after each laminar item is dispensed the medium comes to rest with the next laminar item engaged by the drive means.

8. A device as claimed in claim 7, wherein the command is operative to actuate the drive means to advance the medium until the feature is first detected by the scanner and then to continue actuation of the drive means for a period sufficient to release the laminar item from the drive means but less than that required to move the medium an amount equal to the pitch of the laminar items along the medium.

9. A device as claimed in claim 8, wherein the machine detectable feature is a machine-readable code unique to each laminar item.

10. A device as claimed in claim 1, wherein the predetermined number of laminar item(s) is one.

11. A device as claimed in claim 10, wherein the laminar items are software Certificates of Authenticity labels.

12. A system for dispensing software authorization labels for personal computers (PCs) containing pre-loaded software, each label and each PC bearing a unique machine-readable ID, the system comprising:

a plurality of label dispensing devices each for containing a respective stock of software authorization labels releasably adhered to a transport medium relating to a different item of software;

first means for reading the unique ID on each PC;

means for determining, from a stored record correlating software items with PC ID, which software items are loaded, or are to be loaded, onto each PC;

timer controlled means responsive to each said determining for automatically actuating those devices corresponding to the determining of software items to repeatedly dispense a single label each;

means comprising a pair of pinch rollers, controlled to resist forced manual movement by a self-locking coupling, for engaging the medium adjacent to a slot and, upon actuation, during the medium through the slot;

the pinch rollers pressing on the medium with a sufficient frictional force to rupture the medium and the labels in response to an attempt to manually pull the medium out of the slot;

second means for reading the ID on each label; and the dispensing devices halting each successive label at a position not readable by the second means for reading the ID prior to receipt of a command to advance the next successive label.

13. A system as claimed in claim 12, wherein the system further includes means for storing the codes read by the reader in correlation with the respective PC IDs.

14. A system as claimed in claim 13, wherein each device comprises a housing for containing said stock of labels, said stock of labels being releasably adhered successively along the length of the elongated flexible transport medium, and the pinch rollers driving said transport medium out of a slot in the housing to dispense said labels, and wherein said second means for reading the ID is adapted to scan the medium transversely of its direction of movement, and upon receipt of the command, the drive means is adapted to advance the medium until the machine readable code of a label is first detected by the second means for reading the ID and then to continue actuation of the pinch rollers for a predetermined period sufficient to release the label for removal from the transport medium.

15. A method for dispensing software authorization labels for personal computers (PCs) containing pre-loaded software, each label and each PC bearing a unique machine-readable ID, the method comprising:

providing a plurality of label dispensing devices each containing a respective stock of software authorization labels releasably adhered to a transport medium relating to a different item of software;

reading the unique ID on each PC by a first reading means;

determining, from a stored record correlating software items with PC ID, which software items are loaded, or are to be loaded, onto each PC;

responsive to each said determining, automatically actuating by a timer control device, those devices corresponding to the said determining of software items to repeatedly dispense a single label each;

providing a pair of pinch rollers controlled to resist forced manual movement by a self-locking device for engaging the medium adjacent to a slot and, upon activation, driving the medium through the slot;

the pinch rollers pressing on the medium with a sufficient frictional force to rupture the medium and the labels in response to an attempt to manually pull the medium out of the slot;

reading the ID on each label by a second reading means; and halting each successive label at a position not readable by the second reading means prior to receipt of a command to advance the next successive label.

16. A device for dispensing labels of value comprising:

a secure housing including a lockable cabinet containing an elongated supply of transport medium having a plurality of labels releasably adhered thereto successively along its length;

the housing including an opening through which the transport medium can be discharged;

means separate from the lockable cabinet and actuatable, under timer control, for engaging the medium and drawing only sufficient medium out of the housing to repeatedly expose a single label for removal from the medium, the means for engaging applying a sufficient functional force to rupture the medium in response to an attempt to manually pull the medium through the opening when the means for engaging is not actuated, and the means for engaging being controlled to resist forced manual movement by a self-locking device;

a scanning device; and the labels each including a machine detectable feature, the means for engaging and drawing, halting each successive label at a position not readable by the scanning device prior to receipt of a command to advance the transport medium.

* * * * *